US005163233A

United States Patent [19]

Benson

[11] Patent Number: 5,163,233

[45] Date of Patent: Nov. 17, 1992

[54] STUD ALIGNMENT TOOL

[76] Inventor: Stevan G. Benson, 1 Ascadilla Rd., Worcester, Mass. 01606

[21] Appl. No.: 797,448

[22] Filed: Nov. 21, 1991

[51] Int. Cl.[5] ..... B23P 19/00

[52] U.S. Cl. ..... 33/61.3; 269/904; 33/545

[58] Field of Search ..... 24/545, 547, 563, 570; 269/904, 43, 254 R; 33/613, 645

[56] References Cited

U.S. PATENT DOCUMENTS

| | | | |
|---|---|---|---|
| 1,498,994 | 6/1924 | Borsuk et al. | 24/563 X |
| 1,675,286 | 6/1928 | Valkenburg | 24/563 X |
| 3,201,874 | 8/1965 | Christy | 269/43 X |
| 4,843,726 | 7/1989 | Ward | 269/904 X |

*Primary Examiner*—Harry N. Haroian
*Attorney, Agent, or Firm*—Leon Gilden

[57] ABSTRACT

A "U" shaped clip member is arranged for resilient mounting to contiguous construction studs, wherein the clip member includes spaced parallel plate legs biased towards one another fixedly and orthogonally mounted to a base plate. The base plate includes a "U" shaped channel extending exteriorly of and projecting orthogonally relative to the base plate to define a channel spacing between the channel projection and the base plate to receive a hammer head projection to permit efficient removal of the clip member subsequent to its use in the securement and alignment of construction studs relative to one another. A modification of the invention includes spacer arms projecting exteriorly and orthogonally relative to the side walls to position adjacent studs relative to the "U" shaped member, wherein the spacer arms include a ferromagnetic mounting plate formed at each outer terminal end thereof arranged parallel to the side walls, wherein the ferromagnetic plates are arranged to magnetically clamp to metallic studs or to the use of "U" shaped sockets mounted to the magnetic plates, wherein each of the "U" shaped sockets defines a socket channel to receive adjacent studs therewithin for alignment of adjacent studs relative to a central stud network.

4 Claims, 4 Drawing Sheets

FIG 4
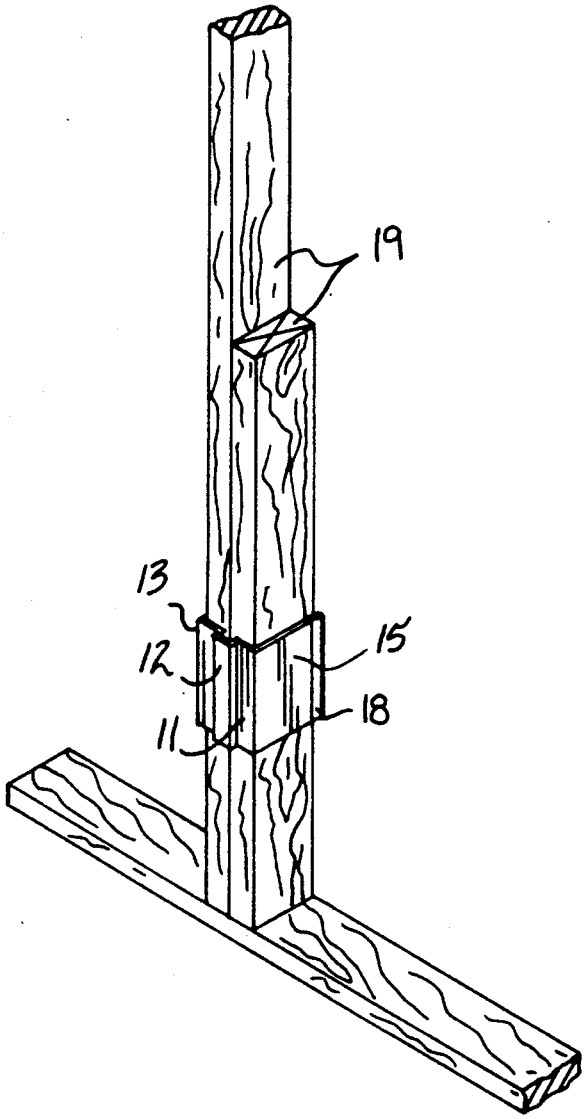
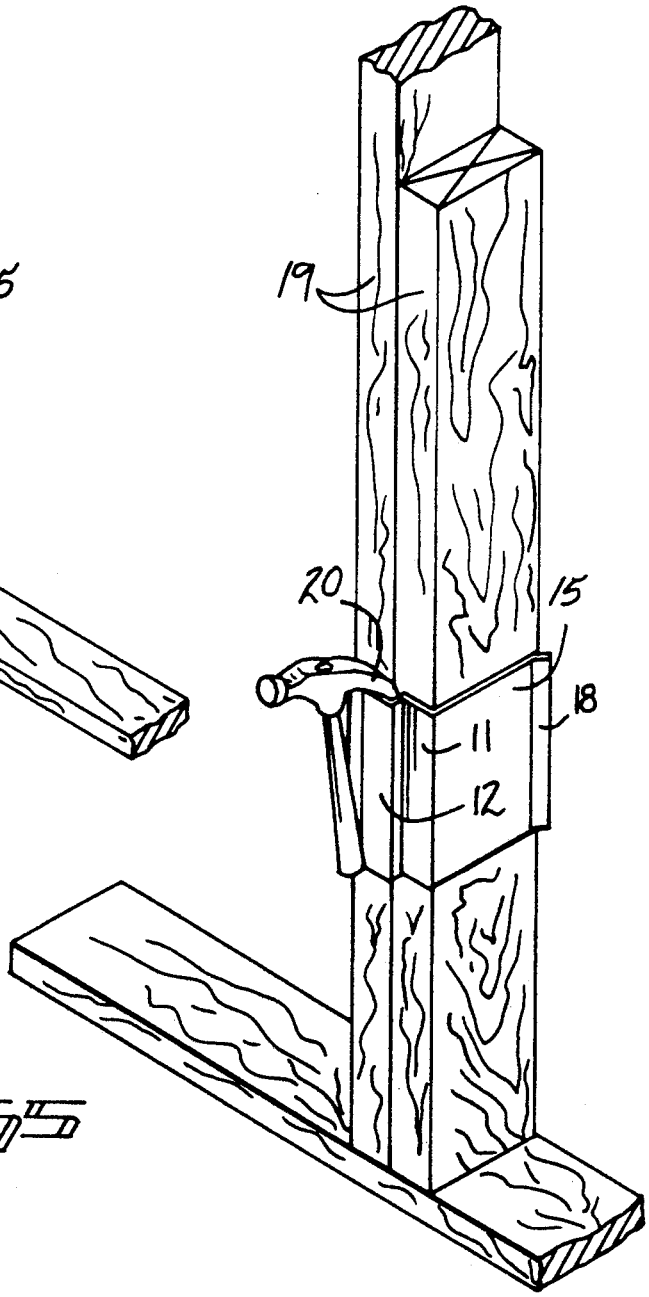
FIG 5

30
35
29
28
31
25
36
21
22
10b
15
37
14
11
12
27
21a
22a
38a
23
24
18
17
23a
24a
10c
26
38

STUD ALIGNMENT TOOL

BACKGROUND OF THE INVENTION

1. Field of the Invention

The field of invention relates to stud alignment tool structure, and more particularly pertains to a new and improved stud alignment tool wherein the same is arranged for the temporary clamping and alignment of construction studs permitting their positioning and securement relative to a construction environment.

2. Description of the Prior Art

Various wall framing and stud mounting structure is utilized in the prior art to position and clamp stud structure prior to their mounting and alignment within a framework. Such apparatus is exemplified in U.S. Pat. No. 4,070,013 to Sickler wherein a stud grouping clamp includes plate members arranged for fastening to side walls of a vertical stud that further include a positioning "L" shaped leg at an upper terminal end thereof for the positioning and mounting of a horizontal stud relative to the vertical stud.

U.S. Pat. No. 4,843,726 to Ward sets forth a stud alignment tool wherein the same utilizes spaced clamps to position adjacent studs relative to one another.

As such, it may be appreciated that there continues to be a need for a new and improved stud alignment tool as set forth by the instant invention which addresses both the problems of ease of use as well as effectiveness in construction in the temporary clamping and mounting of construction studs relative to one another and in this respect, the present invention substantially fulfills this need.

SUMMARY OF THE INVENTION

In view of the foregoing disadvantages inherent in the known types of wall framing apparatus now present in the prior art, the present invention provides a stud alignment tool wherein the same utilizes a "U" shaped spring clip member to temporarily clamp adjacent studs relative to one another permitting their ease of mounting and alignment relative to a wall framing organization. As such, the general purpose of the present invention, which will be described subsequently in greater detail, is to provide a new and improved stud alignment tool which has all the advantages of the prior art wall framing apparatus and none of the disadvantages.

To attain this, the present invention provides a "U" shaped clip member arranged for resilient mounting to contiguous construction studs, wherein the clip member includes spaced parallel plate legs biased towards one another fixedly and orthogonally mounted to a base plate. The base plate includes a "U" shaped channel extending exteriorly of and projecting orthogonally relative to the base plate to define a channel spacing between the channel projection and the base plate to receive a hammer head projection to permit efficient removal of the clip member subsequent to its use in the securement and alignment of construction studs relative to one another. A modification of the invention includes spacer arms projecting exteriorly and orthogonally relative to the side walls to position adjacent studs relative to the "U" shaped member, wherein the spacer arms include a ferromagnetic mounting plate formed at each outer terminal end thereof arranged parallel to the side walls, wherein the ferromagnetic plates are arranged to magnetically clamp to metallic studs or to the use of "U" shaped sockets mounted to the magnetic plates, wherein each of the "U" shaped sockets defines a socket channel to receive adjacent studs therewithin for alignment of adjacent studs relative to a a central stud network.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stud alignment tool which has all the advantages of the prior art wall framing apparatus and none of the disadvantages.

It is another object of the present invention to provide a new and improved stud alignment tool which may be easily and efficiently manufactured and marketed.

It is a further object of the present invention to provide a new and improved stud alignment tool which is of a durable and reliable construction.

An even further object of the present invention is to provide a new and improved stud alignment tool which is susceptible of a low cost of manufacture with regard to both materials and labor, and which accordingly is then susceptible of low prices of sale to the consuming public, thereby making such stud alignment tools economically available to the buying public.

Still yet another object of the present invention is to provide a new and improved stud alignment tool which provides in the apparatus and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the invention arranged for its removal relative to the stud structure.

FIG. 9 is an isometric illustration of a "U" shaped socket member utilized by the invention.

DESCRIPTION OF THE PREFERRED EMBODIMENT

Figure 1:
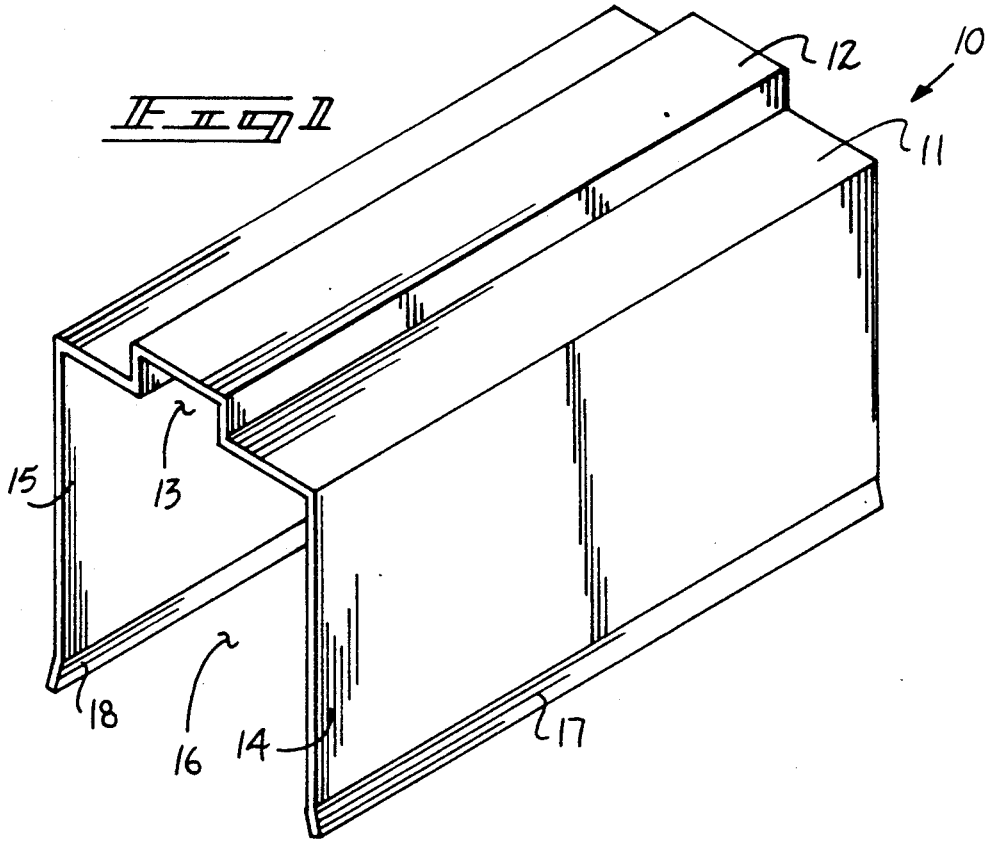
FIG. 1 is an isometric illustration of the instant invention.
Figure 2:
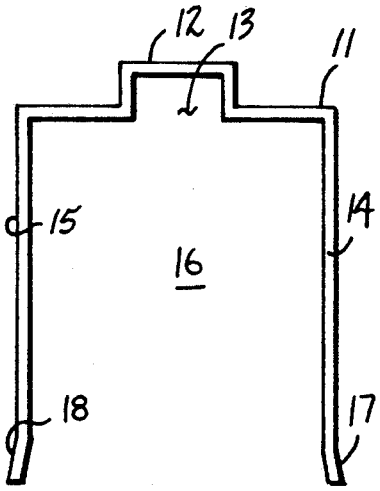
FIG. 2 is an orthographic end view of the instant invention.
Figure 3:
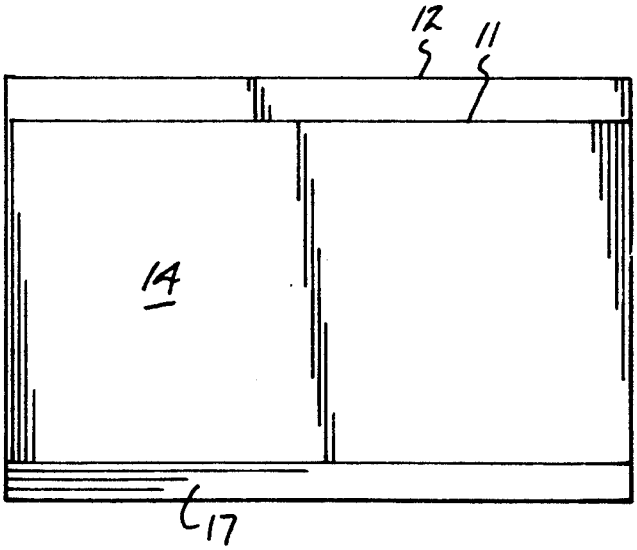
FIG. 3 is an orthographic side view of the instant invention.

With reference now to the drawings, and in particular to FIGS. 1 to 11 thereof, a new and improved stud alignment tool embodying the principles and concepts of the present invention and generally designated by the reference numerals 10, 10*a*, 10*b*, and 10*c* will be described.

Figures 4, 10, 11:
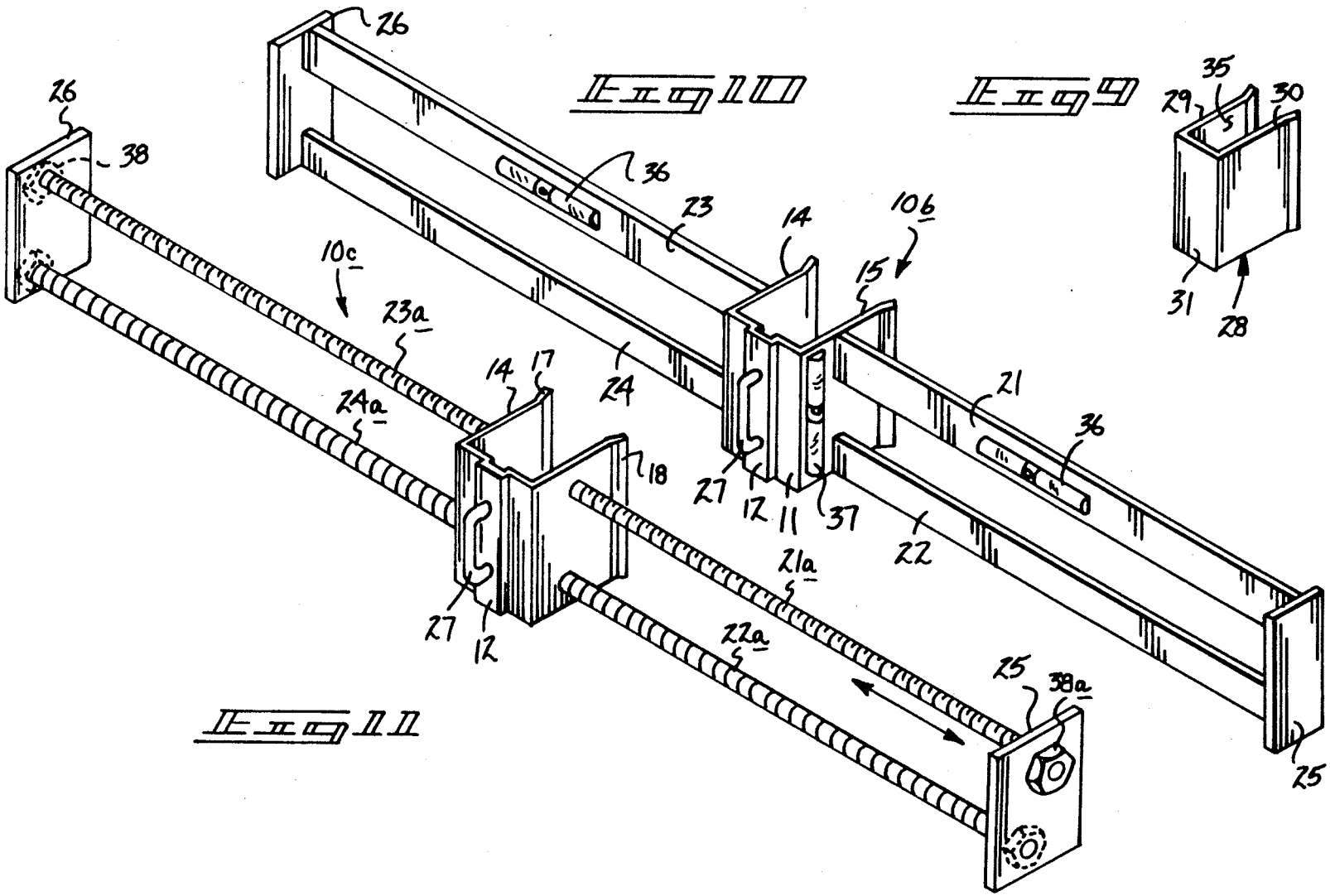
FIG. 4 is an isometric illustration of the invention mounted to a stud structure.
FIG. 10 is an isometric illustration of a further modified aspect of the invention.
FIG. 11 is an isometric illustration of a yet further modified aspect of the invention.

More specifically, the stud alignment tool 10 of the instant invention essentially comprises a "U" shaped member formed with a base plate 11 mounting spaced parallel first and second side walls 14 and 15 relative thereto to define a stud receiving cavity 16. The side walls 14 and 15 are resiliently biased towards one another to define a shape retentent configuration of the "U" shaped member. A "U" shaped channel projection 12 extends exteriorly of the base plate 11 to define a channel spacing 13 permitting reception of a hammer projection 20, in a manner as illustrated in FIG. 5, subsequent to the mounting of the "U" shaped member 11 onto a plurality of contiguous construction stud members 19, as illustrated. The channel spacing 13 thereby permits ease of removal of the "U" shaped member, as discussed above, in a unitary structure. Further, outer distal ends of each of the first and second side walls 14 and 15 include respective outwardly canted first and second side wall lower edges 17 and 18 respectively canted outwardly of the stud receiving cavity 16 to permit ease of mounting of the "U" shaped member onto the stud members 19, such as illustrated in FIG. 4.

Figure 6:
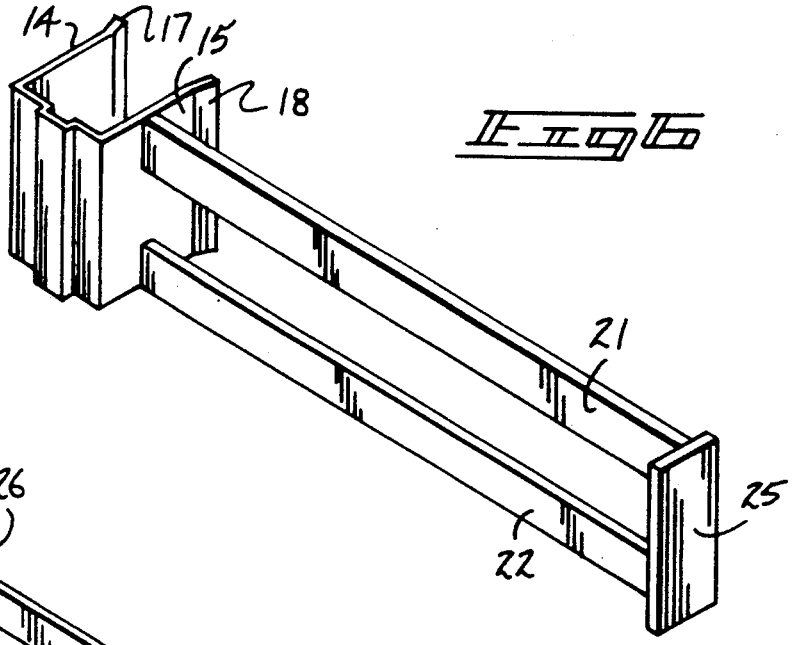
FIG. 6 is an isometric illustration of a modification of the invention.
Figure 7:
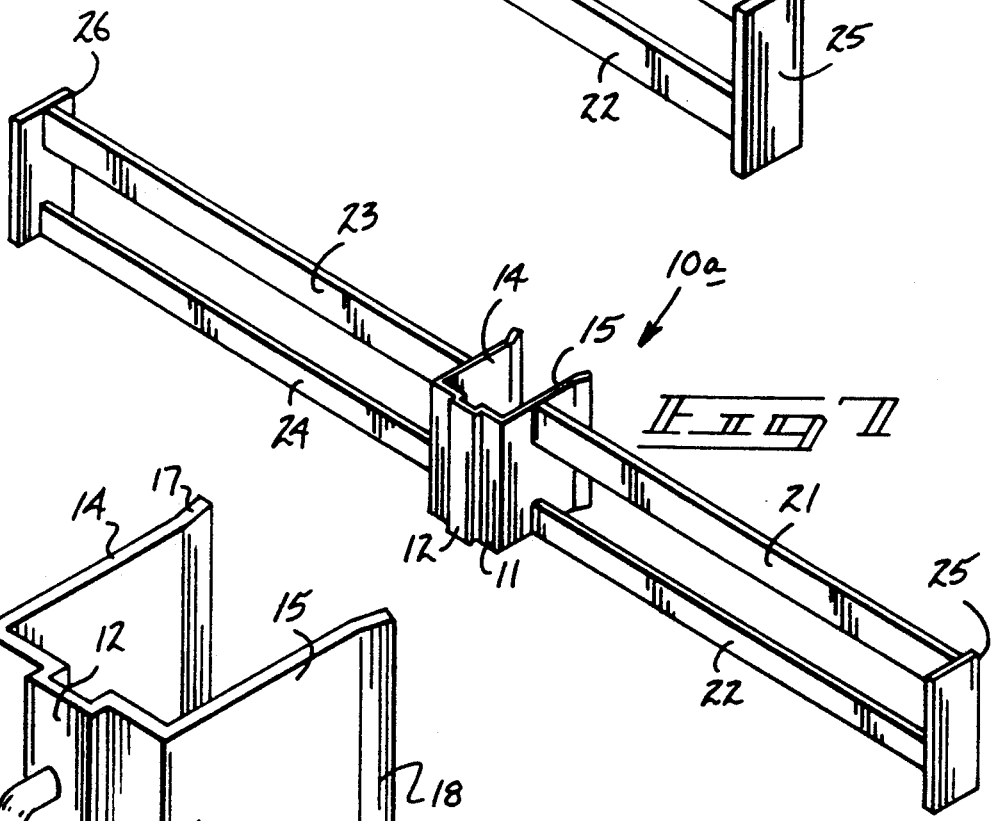
FIG. 7 is an isometric illustration of the modification of the invention utilizing plural pairs of spacer arms to position laterally oriented studs relative to a central stud network.

A modified tool apparatus 10*a*, such as illustrated in FIG. 7, includes respective first and second spacer arms 21 and 22 orthogonally mounted to the second side wall 15 projecting exteriorly thereof, wherein the first and second arms 21 and 22 are arranged parallel to one another. In the configuration of FIG. 6, only the first and second spacer arms 21 and 22 are utilized for mounting of the organization relative to a corner portion of a wall structure to be erected. A first ferromagnetic plate 25 oriented parallel to the side wall 15 is oriented orthogonally relative to the first and second spacer arms 21 and 22 permitting mounting of the first ferromagnetic plate 25 to a metallic stud, or alternatively permit acceptance of a ferrous metallic "U" shaped socket 28, such as illustrated in FIG. 9, that is formed with an exterior wall 29 and an interior wall 30, with the exterior and interior walls biased towards one another in outwardly canted forward terminal ends extending exteriorly of an associated socket channel 35 for insertion into a laterally oriented stud structure relative to the stud structure, such as exemplified in the FIG. 4. A third and fourth spacer arm 23 and 24 respectively may be orthogonally and fixedly mounted to the first side wall 14 utilizing a second ferromagnetic plate 26 permitting securement of the apparatus 10*b* and 10*a* onto laterally oriented stud structure relative to the stud members 19. The third and fourth spacer arms 23 and 24 are parallel relative to one another and orthogonally oriented relative to the first side wall 14 to include the second magnetic plate 26 arranged parallel to the first side wall 14 and orthogonally oriented relative to the third and fourth spacer arms 23 and 24.

Figure 8:
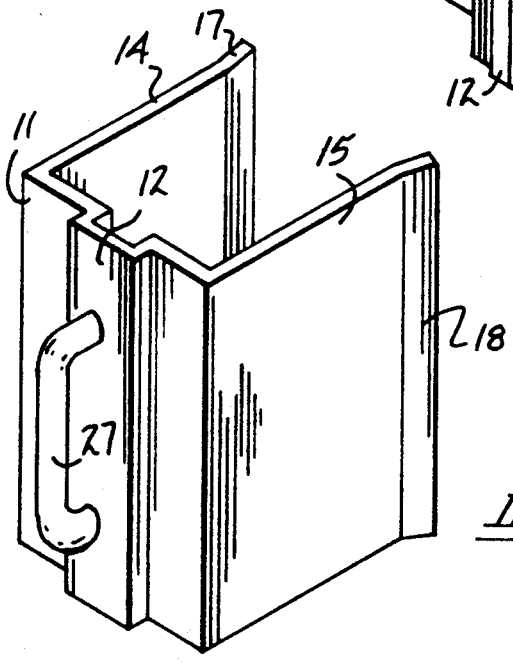
FIG. 8. is an isometric enlarged illustration of the "U" shaped member utilized by the invention mounting a handle for enhanced removal relative to a stud network.

Further, a "U" shaped handle 27 is illustrated in FIG. 8 as fixedly mounted onto the "U" shaped channel projection 12 to permit ease of mounting and dismounting of the "U" shaped member, as illustrated in FIG. 8, onto and arranged for ease of removal from the stud structure 19 to be utilized in association with the hammer projection 20 to simplify the removal and mounting of the apparatus.

The apparatus of 10*b* further utilizes the use of a first spirit level 36 mounted on each of the first and third spacer arms 21 and 23 arranged longitudinally aligned relative to each spacer arm and orthogonally oriented relative to the respective first and second side walls 14 and 15. A second spirit level 37 is arranged mounted to one of the side walls 14 and 15 to provide for proper alignment of the studs 19 and orientation of the spacer arms 21, 22, and 23, 24.

The organization of FIG. 11 illustrates the spacer arms utilized by modified first and second spacer arms 21*a* and 22*a*, as well as modified third and fourth spacer arms 23*a* and 24*a* mounted in a manner described relative to the organization of FIGS. 7 and 10, but to further include an externally threaded configuration that are orthogonally directed through the ferromagnetic plates 25 and 26 respectively utilizing respective internal and external fasteners 38 and 38*a* to be positioned upon opposed sides of a respective ferromagnetic plate to permit spatial adjustment of each plate 25 and 26 relative to the "U" shaped member and the respective side walls 14 and 15 to permit utilization of the organization relative to laterally oriented stud members of varying spacing requirements.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stud alignment tool, comprising, a "U" shaped member, the "U" shapped member including a rigid base plate, the rigid base plate including a first side edge and a second side edge arranged in a parallel relationship, wherein the first side edge includes a first side wall fixedly and orthogonally mounted to the base plate and the second side edge includes a second side wall fixedly and orthogonally mounted to the base plate, wherein the first side wall and second side wall are resiliently biased towards one another to define a stud-receiving cavity therebetween, each of said first and second side walls include a respective first and second side wall lower edge canted outwardly relative to the stud receiving cavity, wherein the first side wall and the second side wall and the first side wall lower edge and the second side wall lower edge are arranged coextensive relative to one another, and the base plate including a "U" shaped channel projection extending exteriorly of the base plate, wherein the projection extends parallel to the base plate first side edge and second side edge to define a channel spacing extending above the base plate in communication with a stud receiving cavity to permit projection of a hammer head projection into the channel spacing when the "U" shaped member is secured about at least one construction stud member, and a "U" shaped handle longitudinally aligned with and mounted fixedly to the channel projection extending exteriorly of the channel projection, and the first side wall includes a first spacer arm and a second spacer arm, wherein the first spacer arm and second spacer arm are arranged parallel relative to one another and orthogonally and integrally mounted to the second side wall, and the first spacer arm and second spacer arm coextensive relative to one another and including a first ferromagnetic plate integrally mounted to the outer distal end of the first spacer arm and the second spacer arm, wherein the first ferromagnetic plate is arranged parallel relative to the second side wall, and further including a first "U" shaped socket arranged for selective securement to the first ferromagnetic plate, wherein the first "U" shaped socket is formed of a ferrous metallic material and includes an exterior wall and an interior wall mounted to a base wall, wherein the exterior wall and interior wall are arranged in a spring-biased relationship relative to one another and the interior wall is selectively securable to the first ferromagnetic plate.

2. An apparatus as set forth in claim 1 including a third spacer arm and a fourth spacer arm fixedly and integrally mounted to the first side wall, wherein the third spacer arm and the fourth spacer arm are coextensive and parallel relative to one another and include a second ferromagnetic plate mounted to an outer distal end of the third spacer arm and fourth spacer arm, wherein the second ferromagnetic plate includes a second ferrous metallic "U" shaped socket arranged for selective securement to the second ferromagnetic plate.

3. An apparatus as set forth in claim 2 wherein at least said first spacer arm includes a first spirit level longitudinally aligned with the first spacer arm integrally mounted to the first spacer arm, and a second spirit level fixedly mounted to said "U" shaped member, wherein the second spirit member is orthogonally oriented relative to the first spirit level.

4. An apparatus as set forth in claim 3 wherein each spacer arm is externally threaded and the first ferromagnetic plate and the second ferromagnetic plate are slidably mounted relative to the first and second spacer arm and the third and fourth spacer arms respectively, and including fastening means mounted to each spacer arm to effect selective adjustment of each ferromagnetic plate relative to the "U" shaped member.

* * * * *